US005911651A

United States Patent [19]

Liu

[11] Patent Number: 5,911,651

[45] Date of Patent: Jun. 15, 1999

[54] DUMBBELL WITH WEIGHTS HAVING ECCENTRIC LOCK FOR SECURING TO GRIP ROD

[76] Inventor: Chang-Fu Liu, No. 206, Dah-Rah Road, Yuan Lin Township, Changhua Hsien, Taiwan

[21] Appl. No.: 09/106,279

[22] Filed: Jun. 29, 1998

[51] Int. Cl.[6] ..... A63B 2/075

[52] U.S. Cl. ..... 482/108; 482/107

[58] Field of Search ..... 482/93, 98, 106–108, 482/111, 112

[56] References Cited

U.S. PATENT DOCUMENTS

| | | | |
|---|---|---|---|
| 3,913,908 | 10/1975 | Speyer | 482/106 |
| 4,076,236 | 2/1978 | Ionel | 482/108 |
| 4,585,367 | 4/1986 | Gall | 482/107 |
| 4,913,422 | 4/1990 | Elmore et al. | 482/106 |
| 5,242,350 | 9/1993 | Chang | 482/108 |
| 5,254,063 | 10/1993 | House, Jr. | 482/107 |
| 5,464,379 | 11/1995 | Zarecky | 482/108 |

*Primary Examiner*—Richard J. Apley
*Assistant Examiner*—Victor K. Hwang
*Attorney, Agent, or Firm*—Bacon & Thomas, PLLC

[57] ABSTRACT

A dumbbell is composed of a grip rod and a plurality of weight containers which are fastened with both ends of the grip rod. The weight containers are provided with a connection protrusion, a connection slot opposite in location to the connection protrusion and engageable with the connection protrusion of another one of the weight containers, thereby enabling a plurality of weight containers to be fastened hand in hand with one end of the grip rod. The weight containers are provided with a receiving space for holding water or sand of a specific weight.

7 Claims, 5 Drawing Sheets

DUMBBELL WITH WEIGHTS HAVING ECCENTRIC LOCK FOR SECURING TO GRIP ROD

FIELD OF THE INVENTION

The present invention relates generally to a dumbbell, and more particularly to a dumbbell having weights that can be joined quickly with a grip rod of the dumbbell.

BACKGROUND OF THE INVENTION

The U.S. Pat. Nos. 5,135,455 and 4,076,236 disclose respectively a dumbbell consisting of weights which are joined by a grip rod by means of threads and the threaded holes. These prior art dumbbells are defective in design in that the weights can not be joined with the grip rod quickly.

SUMMARY OF THE INVENTION

The primary objective of the present invention is therefore to provide an improved dumbbell consisting of a grip rod and two weights each having an eccentric body and a fastening ring for enabling the grip rod to engage or disengage the weights with ease and speed.

The foregoing objective, features, functions, and advantages of the present invention will be more readily understood upon a thoughtful deliberation of the following detailed description of the present invention with reference to the accompanying drawings.

DETAILED DESCRIPTION OF THE INVENTION

Figure 1:
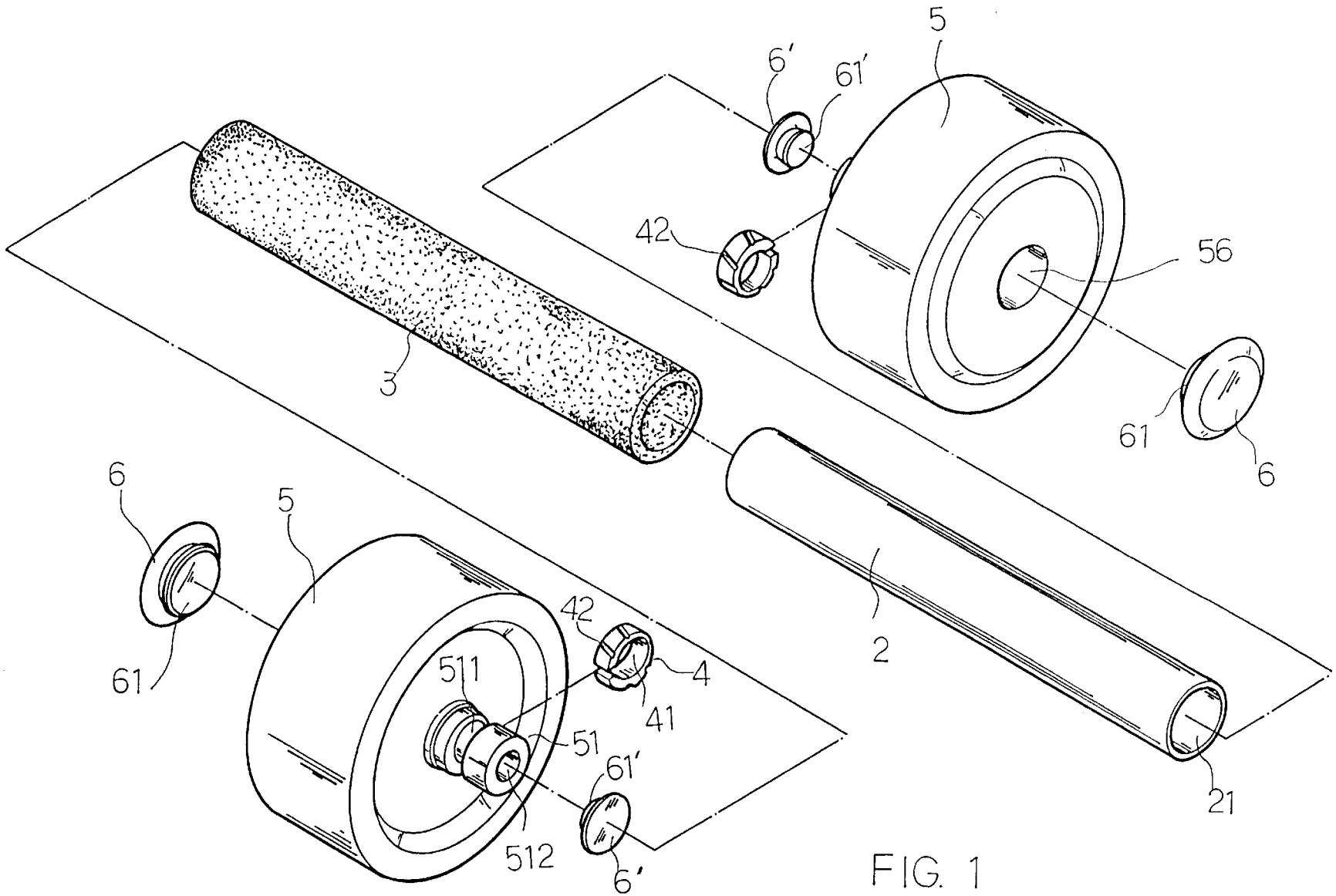
FIG. 1 shows an exploded view of the present invention.

As shown in all drawings provided herewith, a dumbbell embodied in the present invention is mainly composed of a grip rod 2 and two weight containers 5 which are fastened with both ends of the grip rod 2.

The grip rod 2 is provided with an axial holes 21 and is fitted into an axial holes 31 of a protective casing 3 which is made of a foam cotton material.

Figure 2:
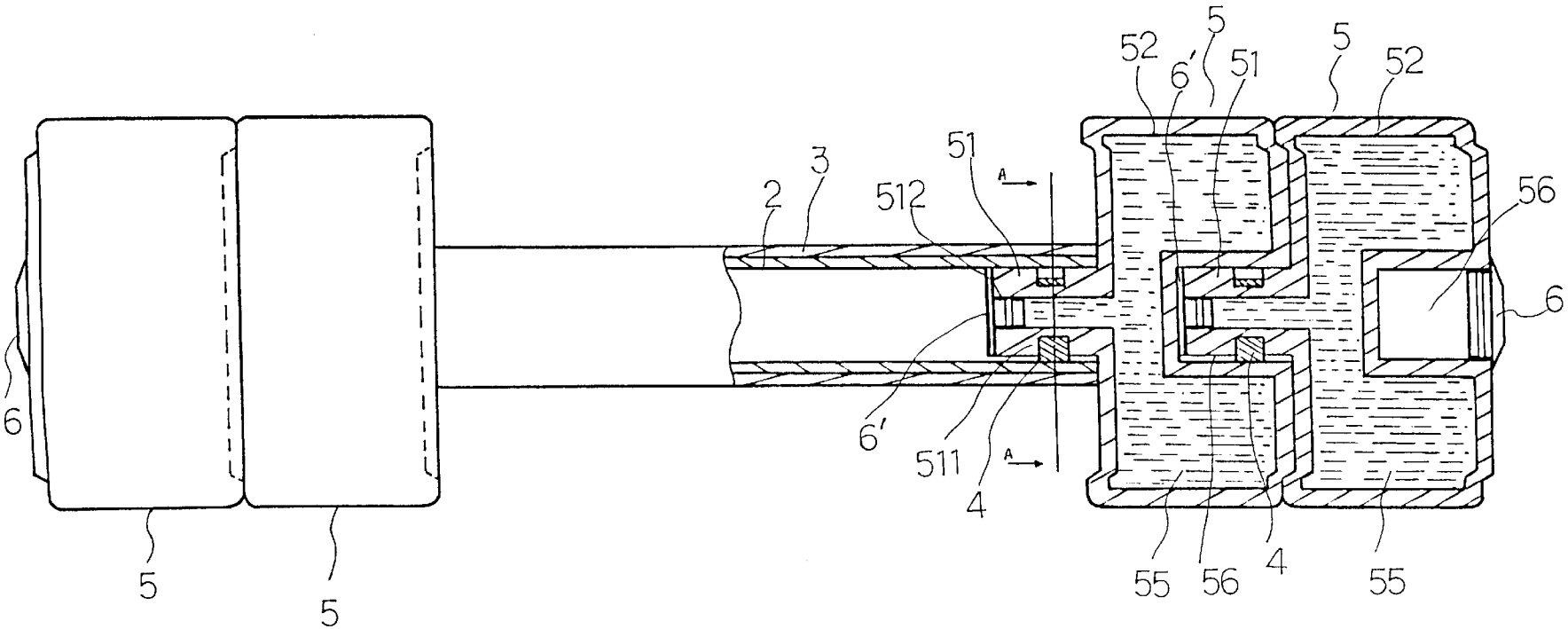
FIG. 2 shows a partial longitudinal sectional view of the present invention in combination.

The weight containers 5 are provided in one side thereof with a connection protrusion 51, and in the interior thereof with a receiving space 52 for holding water or sand 55 of a specific weight. The connection protrusion 51 is dimensioned to fit into the axial holes 21 of the grip rod 2 and is provided in the midsegment thereof with an eccentric body 511 and a slot 512 in communication with the receiving space 52. The weight containers 5 are further provided in another side thereof with a connection slot 56 opposite in location to the connection protrusion 51 and engageable with the connection protrusion 51 of another weight container 5. In other words, a series of weight containers 5 can be fastened hand in hand with one another at either end of the grip rod 2, as shown in FIG. 2. The eccentric body 511 is provided with a fastening ring 4 fastened therewith such that the eccentric body 511 is fitted into an eccentric inner hole 41 of the fastening ring 4. A cap 6 of a T-shaped construction is provided in one side thereof with a connection body 61 which is dimensioned to fit securely into the connection slot 56 of the weight container 5 which is located farthest from the end of the grip rod 2. Another cap 6' of a T-shaped construction is provided in one side thereof with a sealing body 61' which is dimensioned to fit securely and detachably into the slot 512 of the connection protrusion 51 such that the receiving space 52 of the weight container 5 is sealed off.

Figure 3:
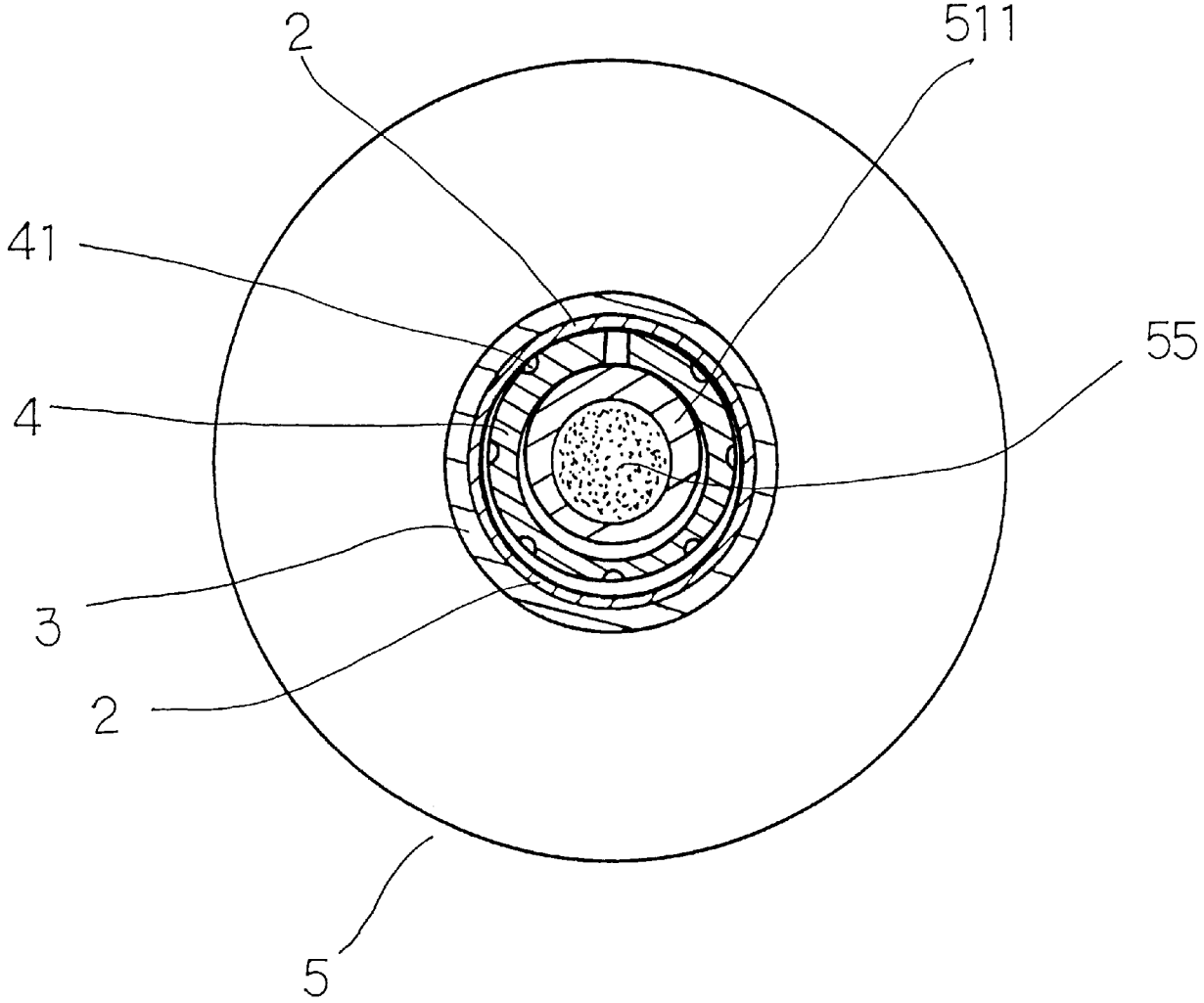
FIG. 3 shows a cross sectional view of the present invention in combination.
Figure 4:
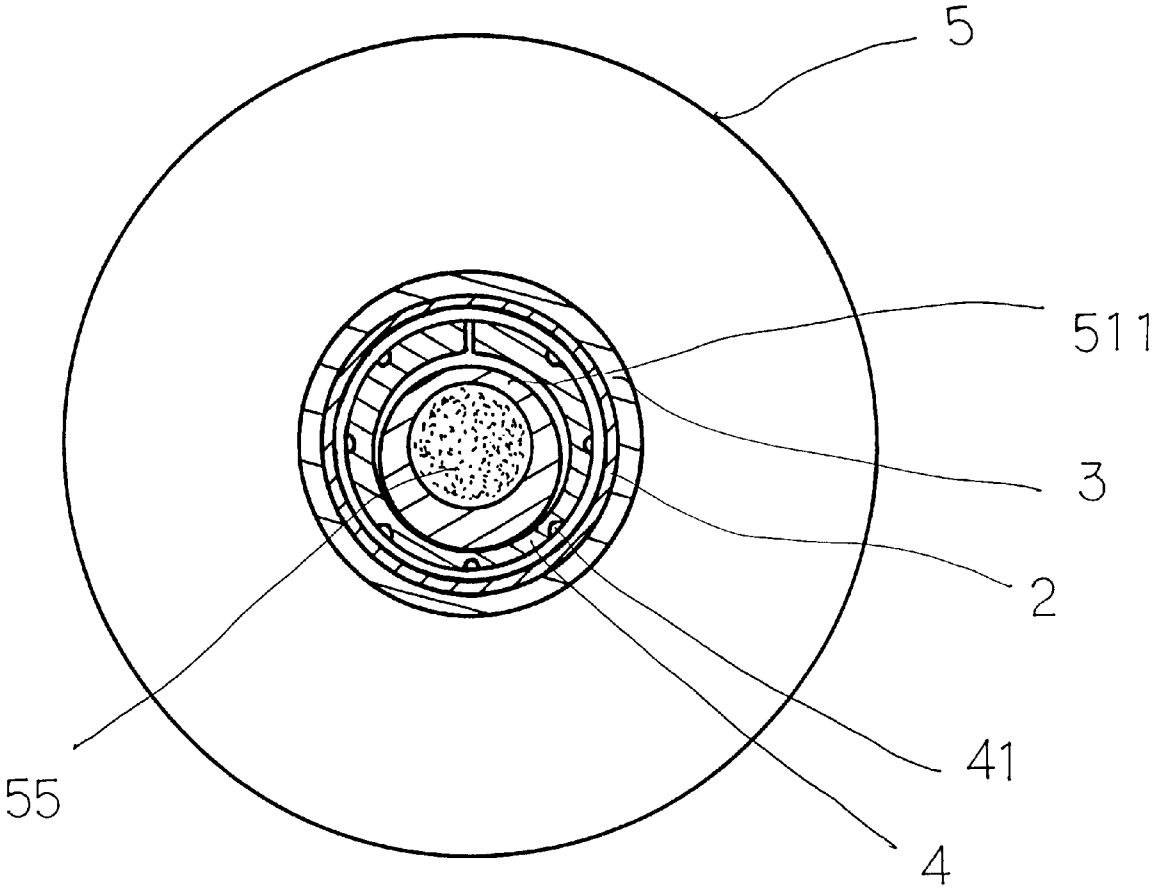
FIG. 4 shows another cross sectional view of the present invention in combination.
Figure 5:
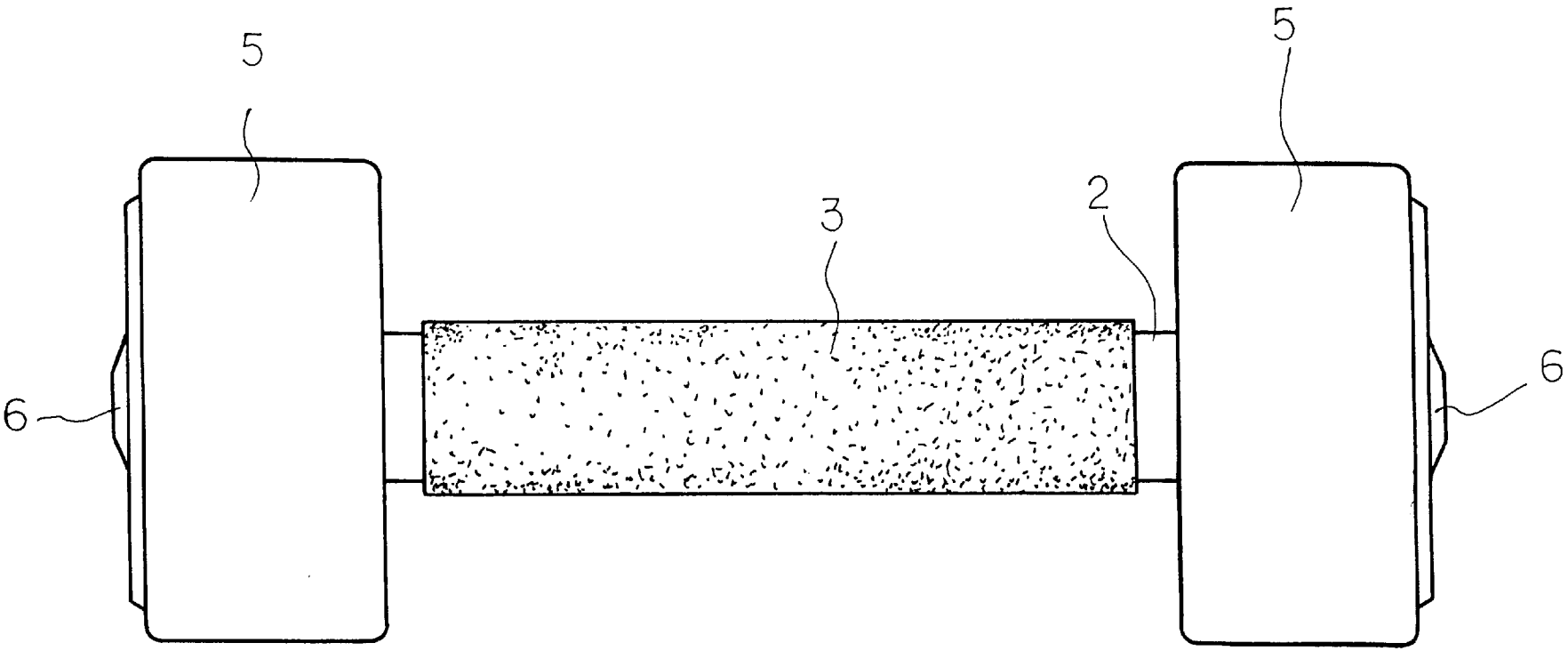
FIG. 5 shows a perspective view of the present invention in combination.

The weight containers 5 can be easily fastened with the grip rod 2 by fitting the connection protrusion 51 of the weight container 5 into the axial hole 21 of the grip rod 2. The weight container 5 is then rotated in a direction such that the fastening ring 4 is actuated to turn, and that the eccentric body 511 of the connection protrusion 51 of the weight container 5 is located in the inner hole 41 of the fastening ring 4, thereby forcing the fastening ring 4 to press against the wall of the axial hole 21 of the grip rod 2, as illustrated in FIG. 3. On the other hand, the weight container 5 can be easily disengaged with the grip rod 2 by turning the weight container 5 in another direction opposite to the direction in which the weight container 5 is rotated to engage securely the grip rod 2, thereby relieving the fastening ring 4 of the force so as to enable the connection protrusion 51 of the weight container 5 to disengage the axial hole 21 of the grip rod 2, as illustrated in FIG. 4.

A plurality of weight containers 5 can be fastened with either end of the grip rod 2 easily and quickly. As shown in FIG. 2, a second weight container 5 is joined with a first weight container 5 which is directly fastened with one end of the grip rod 2. The second weight container 5 is joined with the first weight container 5 such that the connection protrusion 51 of the second weight container 5 is first fitted into the connection slot 56 of the first weight container 5, and that second weight container 5 is then turned in a direction to cause the eccentric body 511 of the connection protrusion 51 to locate in the inner hole 41 of the fastening ring 4, which is in turn forced to press against the connection slot 56. The second weight container 5 can be disengaged with the first weight container 5 by turning the second weight container 5 in another direction opposite to the direction in which the second weight container 5 is turned in the first place to engage the first weight container 5.

The grip rod 2 is fitted into the protective casing 3 capable of protecting the skin of a hand holding the dumbbell of the present invention. In order to enhance the locating effect of the fastening ring 4, the fastening ring 4 is provided in the outside surface thereof with a plurality of skidproof grooves and ridges 42.

The embodiment of the present invention described above is to be deemed in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A dumbbell comprising:

a grip rod with two longitudinal ends provided with an axial hole;

two weight containers substantially identical in construction to each other and fastened to both longitudinal ends of said grip rod, each of said weight containers provided with a connection protrusion which is dimensioned to fit into said axial hole of said grip rod and is provided with a slot, an eccentric body and an eccentric fastening ring fastened with said eccentric body, said weight containers further provided respectively in an interior thereof with a receiving space for holding weighted material of a specific weight, said receiving space being in communication with said slot of said connection protrusion so that the weighted material may pass through said slot; and a sealing body detachably fitted into said slot of said connection protrusion of said weight container such that said receiving space of said weight container is sealed off by said sealing body;

each of said two weight containers being fastened with said grip rod such that said weight container can be rotated in a direction to actuate said fastening ring to turn, and that said eccentric body is located in an inner hole of said fastening ring to force said fastening ring to press against a wall of said axial hole of said grip rod, thereby causing said weight container to engage securely said grip rod, and further that said weight container can be rotated in another direction opposite to the direction in which said weight container is rotated in the first place, thereby resulting in disengagement of said weight container with said grip rod.

2. The dumbbell as defined in claim 1, wherein said grip rod is provided with a protective casing fitted thereover.

3. The dumbbell as defined in claim 2, wherein said protective casing is made of a foam cotton material.

4. The dumbbell as defined in claim 1, wherein said weight containers are respectively provided with a connection slot opposite in location to said connection protrusion and engageable with said connection protrusion of another weight container; and wherein either end of said grip rod is engageable hand in hand with a plurality of said weight containers such that said connection slot of one of said weight containers is engaged with said connection protrusion of another one of said weight containers.

5. The dumbbell as defined in claim 4 further comprising a cap which is engaged with said connection slot of the weight container which is located farthest from said grip rod.

6. The dumbbell as defined in claim 1, wherein said fastening ring has a skidproof outside surface.

7. The dumbbell as defined in claim 6, wherein said skidproof outside surface of said fastening ring is provided with a plurality of grooves and ridges.

* * * * *